US005881581A

United States Patent [19]

Viñas

[11] Patent Number: 5,881,581

[45] Date of Patent: Mar. 16, 1999

[54] APPARATUS FOR THE DRY TREATMENT OF A FABRIC

[75] Inventor: Jaume Anglada Viñas, Matadepera, Spain

[73] Assignee: Turbang Prototips, S.L., Polinyà , Spain

[21] Appl. No.: 704,904

[22] Filed: Aug. 30, 1996

[30] Foreign Application Priority Data

Sep. 7, 1995 [ES] Spain ..... 9501743

[51] Int. Cl.[6] ..... D06B 3/32

[52] U.S. Cl. ..... 68/177; 60/180; 60/207

[58] Field of Search ..... 68/5 C, 5 B, 177, 68/207, 180; 8/152

[56] References Cited

U.S. PATENT DOCUMENTS

| | | | |
|---|---|---|---|
| 2,204,839 | 6/1940 | Welder | 68/180 |
| 4,939,914 | 7/1990 | Driesen et al. | 68/180 |
| 5,046,209 | 9/1991 | Keilhack | 68/180 |
| 5,172,444 | 12/1992 | Penet | 68/180 |
| 5,349,711 | 9/1994 | Iwami | 68/180 |

FOREIGN PATENT DOCUMENTS

| | | | |
|---|---|---|---|
| 2619834 | 3/1989 | France | 68/180 |
| 1904805 | 8/1970 | Germany | 68/180 |
| 3341914 | 6/1985 | Germany | 68/180 |
| 38-3983 | 4/1963 | Japan | 68/180 |

*Primary Examiner*—Frankie L. Stinson
*Attorney, Agent, or Firm*—McGlew and Tuttle, P.C.

[57] ABSTRACT

An apparatus for the dry treatment of a fabric having two enclosures for stocks of fabric, and means for the gradual in-feed and drawing out of the fabric from the enclosures. There are pneumatic means blowing air into a passage which comprises a first portion communicating one enclosure with a space and a second portion communicating another enclosure with the same space. A cylindrical drum is located in this space and adapted to rotate alternately in both directions, such that the fabric entering the space through one of the portions leaves it through the other portion, after partially wrapping the drum.

18 Claims, 2 Drawing Sheets

APPARATUS FOR THE DRY TREATMENT OF A FABRIC

BACKGROUND OF THE INVENTION

The invention relates to an apparatus for the dry treatment of a fabric, comprising: a first enclosure for a stock of in-coming fabric, said enclosure being capable of maintaining said fabric generally disposed in open width form; a second enclosure for a stock of exiting fabric, said enclosure being capable of maintaining said fabric generally disposed in open width form; first means for causing a gradual in-feed of fabric in said first enclosure; second means for providing a gradual removal of fabric from said second enclosure; a passage of flattened section allowing the cloth to pass therethrough in open width form between said first and second enclosures; alternately operating pneumatic means for moving the fabric from one of said enclosures to the other; and control means which when activated cause reversal of said alternate operation.

REFERENCE TO THE PRIOR ART

The currently known apparatus of this type afford a large number of advantages, since during the treatment the fabric is not subjected to mechanical tensions or harmful chafing, since the fabric is moved practically without contact with the walls of the passage, thanks to the air drive in one direction or the other.

Nevertheless, in these known apparatus down times are produced each time there is to be a change of direction, whereby the treatment requires a certain duration. Furthermore, these commonly known apparatus are very voluminous, whereby they require very large spaces for their installation.

SUMMARY OF THE INVENTION

It is an object of the invention to overcome these drawbacks, while maintaining the recognized advantages of the known apparatus. This object is achieved with an apparatus of the type described at the beginning which is characterized by comprising: a space; a rotary cylindrical drum disposed in said space; drive means for said drum, adapted to cause the drum to rotate alternately in both directions and associated with said control means; ad in that said passage comprises a first portion, communicating said first enclosure with said space, and a second portion communicating said second enclosure with said space, allowing the fabric that enters in said space through one of said portions to leave said space through the other portion after partially wrapping said rotary cylindrical drum.

BRIEF DESCRIPTION OF THE DRAWING

Further advantages and features of the invention will be appreciated from the following description in which, without any limiting nature, there is described a preferred embodiment of the invention, with reference to the accompanying drawings, in which.

DETAILED DESCRIPTION OF THE INVENTION

Figure 1:
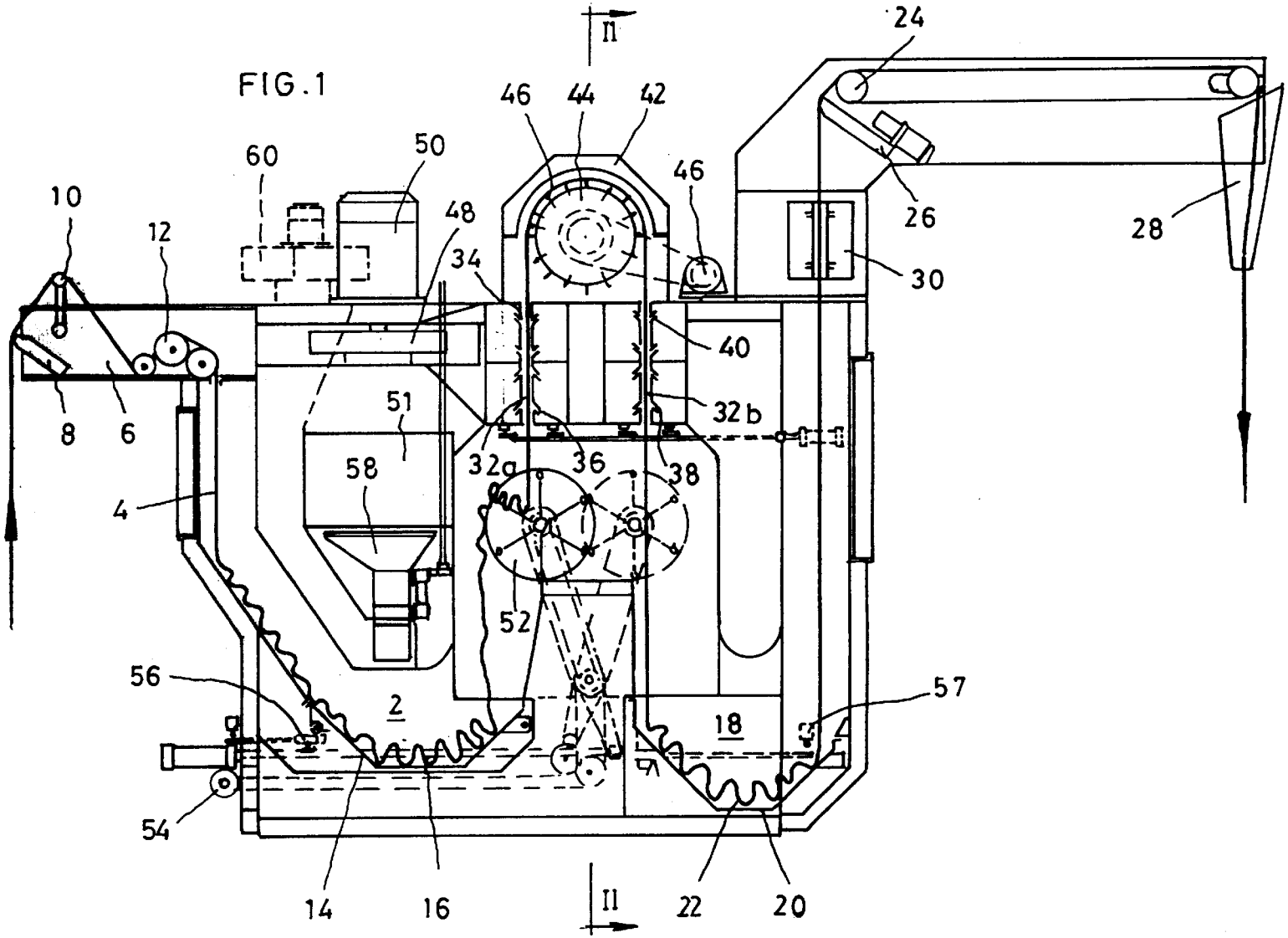
FIG. 1 is a schematic cross section view of the apparatus of the invention, in the longitudinal direction thereof.
Figure 2:
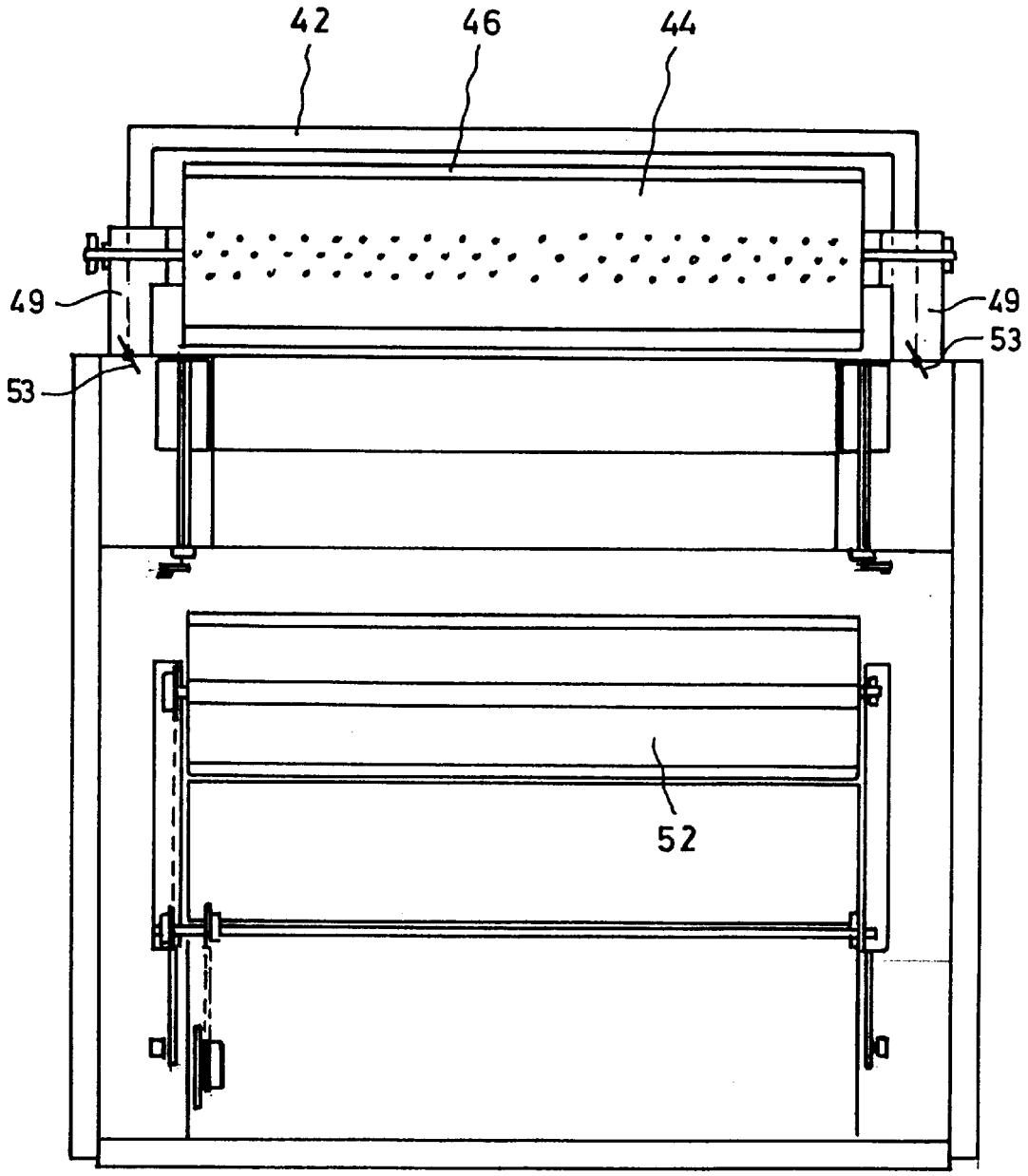
FIG. 2 is a schematic cross section view on the line II—II of FIG. 1.

The apparatus of the present invention comprises a first enclosure 2 for receiving an in-coming fabric 4 from the outside and which is fed into the enclosure 2 by conventional means not forming part of the invention, such as an in-feed bridge 6, a fabric centering means 8, a regulating roll 10 and a set of rolls 12 comprising a drive roll. The fabric is fed in gradually, i.e. slowly and preferably continuously, as indicated later on.

A stock 16 of in-coming fabric may be formed in the enclosure 2 and particularly on the bottom 14 thereof (to be referred to later on) and the dimensions of the enclosure are such that the fabric is disposed in open width form.

The apparatus comprises a second enclosure 18, having a bottom 20 (to which further reference will also be made later on), on which a stock 22 of exiting fabric may be formed; in this case also, the dimensions of the enclosure 18 are such as to maintain the fabric disposed in open width form. The fabric is drawn out of the apparatus by conventional means which do not form part of the present invention either, such as a transport apron 24, a fabric centering means 26 and a folder 28 or other fabric take-up means. Preferably the exiting fabric passes through a cooling means 30, to which a flow of air is applied. The removal of the fabric also takes place gradually, i.e. slowly and preferably continuously.

The fabric 4 moves from the first enclosure 2 to the second enclosure 18 through a passage of flattened section, suitable for containing the fabric in open width form. According to the invention, this passage comprises a first portion 32*a* and a second portion 32*b*, which are preferably generally vertical and mutually parallel. Each of these portions is formed as a nozzle and receives a current of air capable of hauling the cloth along. The air enters the first portion 32*a* alternately through oppositely orientated ports 34 or 36, so that when the air flows in through the ports 34 the fabric is driven into the first enclosure 2, while when blown in through the ports 36 the fabric is drawn out of the first enclosure 2.

In a similar fashion, the air enters the second portion 32*b* alternately through oppositely orientated ports 38 or 40, so that when the air flows in through the ports 40 the fabric is driven into the second enclosure 18, while when blown in through the ports 38 the fabric is drawn out of the second enclosure 18.

There is a conventional mechanism, also outside the scope of the present invention, which alternately: either simultaneously opens the ports 34 and 38, closing the ports 36 and 40, or simultaneously opens the ports 36 and 40, closing the ports 34 and 38.

Both portions 32*a* and 32*b* communicate with a generally closed space 42 in which there is a rotary cylindrical drum 44; the drum 44 is so arranged as to allow the fabric entering in the space 42 through either of the portions 32*a* or 32*b* to leave the same space through the other portion 32*b* or 32*a*, after partly wrapping the drum. The drum 44 may also rotate in either direction and it is driven by a motor 46.

The outer surface of the rotary cylindrical drum 44 is preferably provided with a plurality of longitudinal reliefs 46, which may be continuous or discontinuous and preferably said reliefs 46 are arranged substantially on generating lines of the drum 44.

The apparatus also comprises a fan 48, driven by the motor 50, which generates the required air; known alternately operating pneumatic means (such as gates, dampers and the like not shown) direct the air provided by the fan 48 (as described above) to flow alternately through the ports 34 and 38 or through the ports 36 and 40. There is also provided the unit 51 for heating the air used in the treatment. There are, furthermore, control means which when activated cause reversal of said alternate operation.

The drum 44 is preferably perforated on the outer surface thereof and the interior thereof is in (direct or indirect) communication with the fan 48 through passages 49, which may be regulated with a valve 53. The air flowing axially into the drum 44 and out through the said perforations contributes to move the fabric along and furthermore has a flattening effect on the fabric.

There is also preferably provided a rotor 52 to receive the fabric from one of the portions 32*a* or 32*b*. The rotor 52 is air permeable and is adapted to receive the fabric entering in the enclosures 2 and 18 from the space 42, without retaining it. Since the fabric is blown in with a substantial air pressure, it is advantageous to prevent the fabric from impacting against the bottom of the enclosures and the rotor 52 furthermore allows the fabric to be piled in each enclosure in an orderly fashion and the formation of tangles which may seriously hinder a free passage of the fabric through the portions 32*a* and 32*b*. A description of this rotor is to be found in ES-P-2011141 (application no. 8803076).

The invention contemplates the existence of a single rotor 52 for both portions 32*a* and 32*b*, such that the rotor may oscillate between two positions which are respectively situated at a level below the portions 32*a* and 32*b* and substantially opposite the lower open ends of these portions. There is a geared motor 54 for driving the rotor 52 and appropriate means allowing it to oscillate.

At least one (and preferably both) of the bottoms 14 and 20 of the enclosures 2 and 18 is a weighing platform, i.e. is sensitive to the weight of the fabric deposited thereon. Furthermore, each bottom 14, 20 is associated with a weight control device 56, 57 which, in turn, is associated with the said control means.

Finally, the apparatus may also comprise an automatic filter 58 for dust and lint removal and a fan 60 for exhausting the moist air and the products removed by the filter 58.

For the operation of the apparatus, the fabric is first fed manually through the in-feed bridge 6, fabric centering means 8, regulating roll 10 and set of rolls 12, with the drive roll forming part of the roll set 12 being switched on for a short period of time, whereby a sufficient length of fabric is deposited on the bottom 14 of the first enclosure 2. Through side openings not shown, the leading edge of the fabric is fed by hand up to the lower open end of the portion 32*a* of the passage connecting both enclosures 2 and 18. When the fan 48 is switched on, with the ports 36 open, the fabric is caused to rise towards the space 42 where the fabric is wrapped round the top portion of the drum 44 and fed downwards through the portion 32*b*, whereby the second stock of fabric starts to be formed in the enclosure 18; subsequently the fabric is led to the outside of the apparatus through the apron 24, fabric centering means 26, folder 28 and cooling means 30.

Thereafter a substantial length of fabric is fed in until the in-coming stock is formed. With the pneumatic means (with the ports 36 and 40 open) and the drum 44, the fabric is moved until the exiting stock 22 is formed. Obviously, during this stage, the drum 44 (as seen in FIG. 1) rotates in a clockwise direction. The fabric in-feed means to the first enclosure 2 and the fabric exiting means from the second enclosure 18 are activated.

When the second stock 22 reaches a certain weight (a fact usually coinciding with a substantial exhaustion of the in-coming stock 16), the weighing platform and the control device 57 reverse the cloth flow. Therewith, the air ceases to blow through the ports 36 and 40 and flows through the ports 34 and 38. The drum 44 reverses its rotation and the rotor 52 swings to place itself below the first portion 32*a*. Naturally the fabric is now fed from the second enclosure 18 to the first enclosure 2.

When the stock formed again in the first enclosure 2 reaches the preset weight, the flow is reversed again and the whole operation is repeated until the fabric treatment has terminated.

The inclusion of the drum 44 provides a notable acceleration in the changes of direction, reducing the down times to a minimum. Furthermore, the fact that the connecting passage between both enclosures 2 and 18 is disposed in two vertical portions 32*a* and 32*b* allows the longitudinal dimension of the apparatus to be reduced. Also, the economy represented by the presence of a single rotor 52 should be highlighted.

What I claim is:

1. An apparatus for dry treatment of a fabric, comprising:

a first enclosure for a stock of in-coming fabric, said first enclosure being capable of maintaining said fabric generally disposed in open width form;

a second enclosure for a stock of exiting fabric, said second enclosure being capable of maintaining said fabric generally disposed in open width form;

first means for causing a gradual in-feed of fabric in said first enclosure;

second means for providing a gradual removal of fabric from said second enclosure;

a passage of flattened section allowing the fabric to pass therethrough in open width form between said first and second enclosures;

alternately operating pneumatic means for moving the fabric from one of said enclosures to the other;

control means which when activated cause reversal of said alternate operation;

a space;

a rotary cylindrical drum disposed in said space;

drive means for said drum, adapted to cause the drum to rotate alternately in both directions and associated with said control means, said passage including a first portion, communicating said first enclosure with said space, and a second portion communicating said second enclosure with said space, allowing the fabric that enters in said space through one of said portions to leave said space through the other portion after partially wrapping said rotary cylindrical drum.

2. The apparatus of claim 1, wherein said rotary cylindrical drum is provided with a plurality of reliefs on the outer surface thereof.

3. The apparatus of claim 2, wherein said reliefs are substantially arranged on generating lines of the rotary cylindrical drum.

4. The apparatus of claim 1, wherein said rotary cylindrical drum is perforated and the interior thereof is in communication with said pneumatic device.

5. The apparatus of claim 4, wherein said air communication between said drum and said pneumatic device is adjustable.

6. The apparatus of claim 1, wherein said portions of said passage are generally vertical.

7. The apparatus of claim 1, wherein at least the bottom of one of said enclosures is a weighing platform and there is a device for controlling the weight of the fabric deposited on said weighing platform, said control device being adapted to activate said control means.

8. The apparatus of claim 1, having an air permeable rotor receiving the fabric entering in one of said enclosures from one of said portions without retaining it, wherein said rotor may swing between two positions respectively situated at a level below said two portions of said passage.

9. The apparatus of claim 8, wherein the oscillation of said rotor is associated with said control means.

10. An apparatus for treating a fabric, the apparatus comprising:

a first enclosure for a stock of in-coming fabric, said first enclosure dimensioned for maintaining said fabric generally disposed in open width form;

a second enclosure for a stock of exiting fabric, said second enclosure dimensioned for maintaining said fabric generally disposed in open width form;

a fabric in-feed device feeding fabric in said first enclosure;

a fabric removal device removing fabric from said second enclosure;

a passage of flattened section allowing the fabric to pass therethrough in open width form between said first and second enclosures;

a fan directed for moving the fabric from one of said enclosures to the other;

a control device connected to said pneumatic device controlling the activation of the pneumatic device;

a space;

a rotary cylindrical drum disposed in said space;

a drive connected to said drum to cause the drum to rotate alternately in both directions and associated with said control device, said passage having a first portion, providing communication between said first enclosure and said space, and a second portion providing communication between said second enclosure and said space, allowing the fabric that enters in said space through one of said portions to leave said space through the other portion after partially wrapping said rotary cylindrical drum.

11. The apparatus of claim 10, wherein said rotary cylindrical drum is provided with a plurality of reliefs on the outer surface thereof.

12. The apparatus of claim 11, wherein said reliefs are substantially arranged on generating lines of the rotary cylindrical drum.

13. The apparatus of claim 10, wherein said rotary cylindrical drum is perforated and the interior thereof is in communication with said fan.

14. The apparatus of claim 13, wherein said air communication between said drum and said fan is adjustable.

15. The apparatus of claim 10, wherein said portions of said passage are generally vertical.

16. The apparatus of claim 10, wherein at least the bottom of one of said enclosures is a weighing platform and there is a weight control device for controlling the weight of the fabric deposited on said weighing platform, said weight control device being adapted to activate said control device.

17. The apparatus of claim 10, having an air permeable rotor receiving the fabric entering in one of said enclosures from one of said portions without retaining it, wherein said rotor is swingable between two positions respectively situated at a level below said two portions of said passage.

18. The apparatus of claim 17, wherein the oscillation of said rotor is associated with said control device.

* * * * *